US011506014B1

(12) United States Patent
Zhang et al.

(10) Patent No.: US 11,506,014 B1
(45) Date of Patent: Nov. 22, 2022

(54) TEMPORARY WELLBORE BARRIER USING FERROMAGNETIC FLUID

(71) Applicant: HALLIBURTON ENERGY SERVICES, INC., Houston, TX (US)

(72) Inventors: Wei Zhang, Houston, TX (US); Mark Holly, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/305,475

(22) Filed: Jul. 8, 2021

(51) Int. Cl.
*E21B 33/13* (2006.01)
*E21B 36/00* (2006.01)
*E21B 33/124* (2006.01)

(52) U.S. Cl.
CPC ..... *E21B 33/13* (2013.01); *E21B 33/124* (2013.01); *E21B 36/008* (2013.01)

(58) Field of Classification Search
CPC ..... E21B 33/13; E21B 33/124; E21B 26/008
See application file for complete search history.

(56) References Cited

U.S. PATENT DOCUMENTS

| | | | | |
|---|---|---|---|---|
| 8,240,384 | B2 * | 8/2012 | Miller | E21B 29/10 166/381 |
| 9,163,475 | B2 * | 10/2015 | Meinke | E21B 33/10 |
| 2006/0144591 | A1 | 7/2006 | Gonzalez et al. | |
| 2011/0186297 | A1 | 8/2011 | Zhang et al. | |
| 2012/0318510 | A1 * | 12/2012 | Ocalan | E21B 47/00 166/300 |
| 2017/0191341 | A1 | 7/2017 | Fripp et al. | |

FOREIGN PATENT DOCUMENTS

| | | | |
|---|---|---|---|
| WO | 2015094274 | A1 | 6/2015 |
| WO | 2019236059 | A1 | 12/2019 |

* cited by examiner

*Primary Examiner* — Silvana C Runyan
(74) *Attorney, Agent, or Firm* — Sheri Higgins Law, PLLC; Sheri Higgins

(57) ABSTRACT

A ferromagnetic fluid can be used to provide a temporary barrier in a wellbore. A magnetic sub can generate an electromagnetic field within the wellbore. The ferromagnetic fluid is retained at a desired location within the wellbore by the electromagnetic field. Ferromagnetic particles in the fluid can clump together or settle to form the temporary barrier. A zonal isolation fluid such as a metallic fluid, a cement composition, or a curable resin composition can be introduced on top of the temporary barrier. The zonal isolation fluid can solidify to form a permanent or semi-permanent barrier to provide zonal isolation of different zones of the subterranean formation.

20 Claims, 5 Drawing Sheets

TEMPORARY WELLBORE BARRIER USING FERROMAGNETIC FLUID

TECHNICAL FIELD

A temporary barrier using ferromagnetic fluid and use are provided. The ferromagnetic fluid can create a temporary barrier adjacent to a magnetic field in a tubing string or annulus of a wellbore. A permanent or semi-permanent barrier can be placed above the temporary barrier.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1:
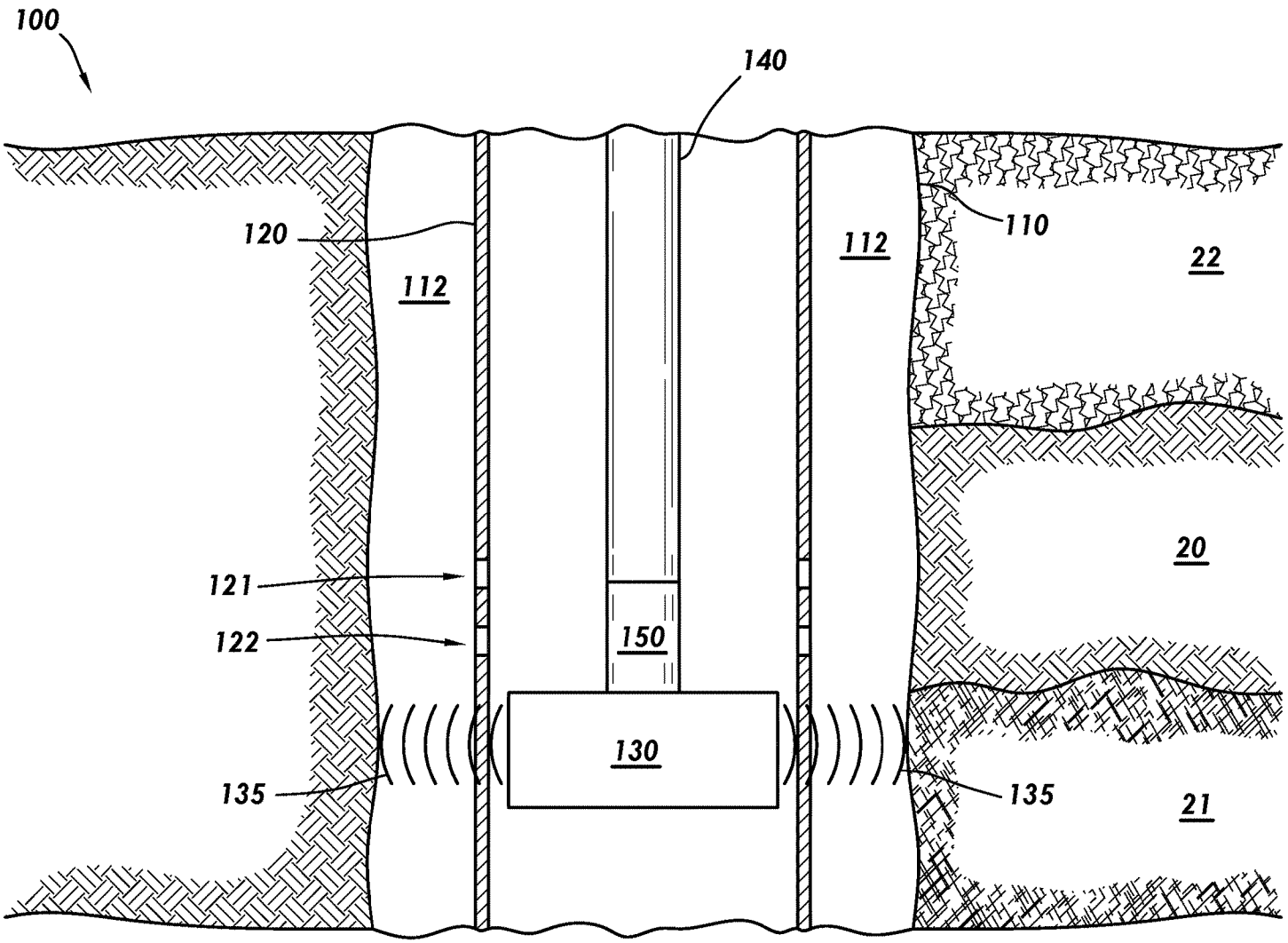
FIG. 1 is a cross-sectional view of a well system including a magnetic sub according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals, "MPa"). A fluid can be a liquid or gas. A homogenous fluid has only one phase, whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to: the space between a wall of the wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. During well completion, it is commonly desired to isolate one zone of a subterranean formation from another zone. An isolation device can be used for zonal isolation and functions to block fluid flow within a tubular, such as a casing, or within an annulus. The blockage of fluid flow prevents the fluid from flowing across the isolation device in any direction (either downstream or upstream) and isolates the zone of interest. As used herein, the relative term "downstream" means at a location further away from a wellhead. As used herein, the relative term "upstream" means at a location closer to the wellhead. By isolating different zones, oil, gas, water, or combinations thereof can be produced in a controlled manner through the wellhead via the tubing string or casing.

A variety of mechanisms can be employed to provide zonal isolation. Mechanical devices, such as plugs or darts, can create a barrier within a tubing string or casing. Zonal isolation fluids, such as cement compositions or resin fluids, can also be used to create a barrier—typically within a wellbore annulus. These mechanisms can be classified as permanent barriers (which remain within the wellbore) or semi-permanent barriers (which can be removed from the wellbore via milling or degradation for example).

As used herein, a "cement composition" is a mixture of at least cement and water. A cement composition can include additives. As used herein, the term "cement" means an initially dry substance that develops compressive strength or sets in the presence of water. A resin fluid can include a curable resin. A cement composition and a curable resin can set. As used herein, the term "set," and all grammatical variations thereof, means the process of becoming hard or solid by curing. A curing agent can be contacted with a curable resin to cause the resin to set. A cement composition or resin fluid can be designed based on the specific properties desired (e.g., a decreased permeability of the set cement composition or resin fluid).

New types of zonal isolation fluids are being developed. For example, metallic barriers are being used and can be used in lieu of cement compositions. Metals and/or metal alloys can be heated or melted to create zonal isolation within a wellbore. The metal or alloy can be in the form of particles suspended within a carrier fluid that are carried downhole to a desired location within the wellbore and then exposed to a heat source to melt the particles. Upon cooling, the particles fuse together and solidify to form the zonal isolation barrier. The heat source can be, for example, an electric heater, the downhole temperature of the wellbore, a heated fluid, or a thermite reaction.

A thermite reaction is an exothermic oxidation-reduction reaction involving thermite. Thermite is a blend of a metal, called a fuel, and an oxide. The oxide is commonly a metal oxide. Some examples of fuels include, but are not limited to, aluminum, magnesium, calcium, titanium, zinc, silicon, and boron, with aluminum being the most common. Some examples of metal oxides include, but are not limited to, boron(III) oxide, silicon(IV) oxide, chromium(III) oxide, manganese(IV) oxide, iron(II, or III) oxide, copper(II) oxide, and lead(II, III, or IV) oxide. The reactants are most often ground into a powder and then mixed with a binder to keep the reactants mixed together. The reactants/binder mixture is often a solid. An example of a thermite reaction using iron(III) oxide and aluminum is shown below.

$$Fe_2O_3+2Al \rightarrow 2Fe+Al_2O_3$$

The initiation temperature that causes the reaction can vary depending on the particle size of the reactants and the specific reactants used. Fuses, such as strips of metal that have been ignited, heated fluids, or electric heaters can be used to initiate a thermite reaction. Another common technique for initiation of a thermite reaction is to use the heat produced from another exothermic reaction, such as the reaction between potassium permanganate and glycerol or ethylene glycol, to initiate the thermite reaction. It is helpful for the chosen reactive metal (the fuel) to have a low melting point and a high boiling point relative to other metals. By having a low melting point, the fuel melts at a lower temperature, enabling the reaction to occur in a liquid phase. A liquid-phase fuel allows the reaction to proceed quickly. The lower the melting point of the reactive metal, the lower the required initiation temperature. The reactants and particle size can be selected such that the metals melt and then fuse together and solidify when cooled to form the barrier.

The zonal isolation fluid (e.g., metal or metal alloy particle fluids, cement compositions, resin compositions, etc.) must be retained at the desired location within the wellbore prior to solidifying. Currently, this is accomplished by running a mechanical device into the wellbore ahead of the zonal isolation fluid. The mechanical device creates a restriction within the wellbore and prevents the fluid from flowing downstream away from the zone of interest. The mechanical device can hold a desired position within the tubing or casing string and allows the particles or fluid to settle in a column that eventually solidifies to create the zonal isolation. An example of a mechanical device that can be used for this purpose is an anchor/petal assembly.

There are several disadvantages to using a mechanical device to retain the zonal isolation fluid. One significant disadvantage is a mechanical device can only be used within a tubing string or casing, which prevents zonal isolation within an annulus. Another disadvantage is that mechanical devices can be costly and time consuming to run into the wellbore. Another disadvantage is that it may be difficult to remove the mechanical device after zonal isolation is no longer required. As such, there is a need and ongoing industry concern for improved ways to retain zonal isolation fluids at a desired location within a tubing string or casing or wellbore annulus.

Novel temporary barriers are disclosed. The temporary barrier can include a ferromagnetic fluid that is retained at a desired location within a wellbore via a magnetic field. Some of the many advantages of the novel temporary barrier include: the ferromagnetic fluid can be used to create a temporary barrier within a tubing string and an annulus; the time required to create the temporary barrier is less than the time required to install an anchor/petal assembly; the temporary barrier does not require a mechanical device, such as an anchor/petal assembly, to remain in the desired location; and it is easier to remove the temporary barrier from the location when no longer needed.

A wellbore system comprises: a wellbore; a ferromagnetic fluid, wherein the ferromagnetic fluid creates a temporary barrier within the wellbore; a magnetic sub, wherein the magnetic sub is configured to generate an electromagnetic field; and a zonal isolation fluid, wherein the zonal isolation fluid is retained within a desired location within the wellbore via the ferromagnetic fluid.

A method of isolating a first zone from a second zone of a subterranean formation comprises: introducing a magnetic sub into a wellbore, wherein the wellbore penetrates the subterranean formation; causing or allowing the magnetic sub to generate a magnetic field; introducing a ferromagnetic fluid into the wellbore to form a temporary barrier within the wellbore, wherein the temporary barrier is located adjacent to the magnetic field; introducing a zonal isolation fluid into the wellbore, wherein the zonal isolation fluid is located adjacent to the temporary barrier; and causing or allowing at least a portion of the zonal isolation fluid to solidify.

It is to be understood that the discussion of any of the embodiments regarding the fluids and devices is intended to apply to all of the system and method embodiments without the need to repeat the various embodiments throughout.

Turning to the Figures, FIG. 1 is a cross-sectional view of a well system 100. The well system 100 includes a subterranean formation 20. The subterranean formation 20 can include a first zone 21 and a second zone 22. The subterranean formation 20 can also include a plurality of zones. A wellbore can penetrate the subterranean formation 20. The wellbore can include a wellbore wall 110.

A tubing string 120 can be run into the wellbore. The tubing string 120 can be a casing string. There can also be more than one tubing string 120, for example, a casing string and a tubing string located within the casing string. The wellbore can include an annulus 112. Although the Figures show the annulus 112 located between the outside of the tubing string 120 and the inside of the wellbore wall 110, it is be understood that the annulus can be located between a variety of different wellbore components, such as between a casing string and a tubing string or between a casing string and wellbore wall. Additionally, there can be more than one annulus in the wellbore.

Although not required, the tubing string 120 can include two or more sets of perforations that allows fluid communication from the inside of the tubing string 120 and the annulus 112. Perforations are openings made in the tubing string 120—commonly using a perforating gun or shaped charges. As shown in FIG. 1, the tubing string 120 can include a first set of perforations 121 and a second set of perforations 122. As used herein, a "set of perforations" means two or more perforations. The two or more perforations can be spaced a desired distance from each other circumferentially around the tubing string 120. The two or more perforations for a given set can be vertically in-line with each other along a longitudinal axis of the tubing string or spirally spaced. However, it is be understood that the first set of perforations 121 should be vertically distanced from the second set of perforations 122. The vertical distance between the first and second set of perforations 121/122 can vary and can be selected from 6 inches to 10 feet, for example.

A run-in tool 140 can be used to convey a variety of components into the tubing string 120. The run-in tool 140 can be any tool to convey components into the tubing string 120, including but not limited to, wireline, slickline, digital slickline, or coiled tubing. As shown in FIG. 1, the run-in tool 140 can be used to convey a magnetic sub 130 into the tubing string 120 to a desired location. The desired location can be where zonal isolation is desired. For example, the desired location can be at or near the demarcation between the first zone 21 and the second zone 22 of the subterranean formation 20. According to this example, reservoir fluids from the first zone 21 would be prevented from being produced, but reservoir fluids from the second zone 22 could be produced.

According to any of the embodiments, a heater 150 can also be conveyed into the tubing string 120 via the run-in tool 140. The heater 150 can be any device that emits heat upon activation, for example, an electrical heater that utilizes coils or frequency, or a chemical heater. If a heater 150 is used, then the heater 150 can be installed at a desired location within the tubing string 120, which may be adjacent to the magnetic sub 130 or some distance away from the magnetic sub 130. According to any of the embodiments, the heater 150 is installed near a zonal isolation fluid that requires heat to solidify.

Figure 2:
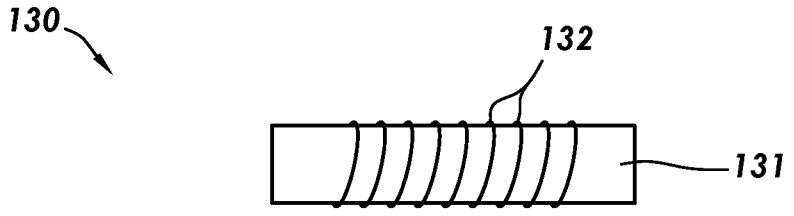
FIG. 2 is a front view of the magnetic sub with an electromagnet according to certain embodiments.

The magnetic sub 130 is configured to generate an electromagnetic field 135. The magnetic sub 130 can be any device that can generate the electromagnetic field 135. FIG. 2 shows a magnetic sub 130 according to certain embodiments. The magnetic sub 130 can be an electromagnetic coil 132. The electromagnetic field 135 is produced when an electrical current is passed through the electromagnetic coil 132. The advantage of using a coil shape is that it increases the strength of the magnetic field produced by a given current. As shown in FIG. 2, the electromagnetic coils 132 can be wrapped around a ferromagnetic core 131 in a variety of configurations. The addition of the core 131 can be used to increase the strength and/or dimensions of the electromagnetic field 135. The core 131 can be made from any type of ferromagnetic material, for example, mild steel or iron. The well system 100 can further include a power source (not shown) to produce an electrical current to produce the electromagnetic field 135. The power source can be part of the run-in tool 140 or part of any other component. A switch can also be included in the well system 100 to activate and deactivate the power source and electrical current.

Figure 3:
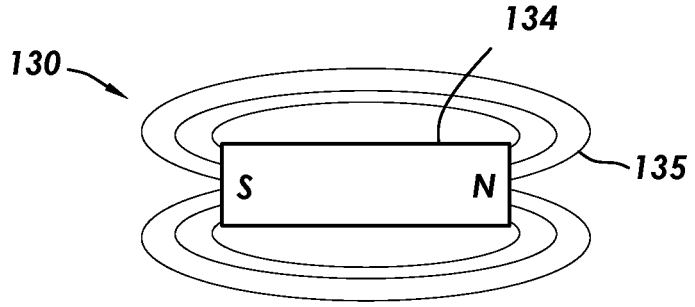
FIG. 3 is a front view of the magnetic sub with a permanent magnet according to certain other embodiments.

FIG. 3 illustrates the magnetic sub 130 according to other embodiments. The magnetic sub 130 can be a permanent magnet 134. As can be seen in FIG. 3, the permanent magnet 134 generates an electromagnetic field 135 between the North and South poles of the magnet. In contrast to an electromagnetic coil, a permanent magnet 134 does not require a power source to generate the electromagnetic field 135.

The permanent magnet 134 can be made from a variety of materials that is selected in part based on the desired longevity of the electromagnetic field 135 that is generated, the overall cost of the material, and the desired strength of the electromagnetic field 135. The material can be a soft material (i.e., a material that loses it magnetization), such as annealed iron, or a hard material (i.e., a material that forms a permanent magnet that does not demagnetize), such as alnico or ferrite. Ceramic or ferrite magnets are generally made of a sintered composite of powdered iron oxide and barium/strontium carbonate ceramic. Alnico magnets can be made by casting or sintering a combination of aluminum, nickel, and cobalt with iron and small amounts of other elements added to enhance the properties of the magnet. Sintering can offer superior mechanical characteristics, whereas casting can deliver higher magnetic fields and allows for the design of intricate shapes. Alnico magnets tend to be more resistant to corrosion and have physical properties more forgiving than ferrite, but not quite as desirable as a metal. The permanent magnet can also be a rare-earth magnet. Rare earth elements, such as lanthanoid, have a partially occupied f electron shell, which can accommodate up to 14 electrons. The spin of these electrons can be aligned, resulting in very strong magnetic fields; therefore, these elements are used in compact high-strength magnets where their higher price is not a concern. Rare-earth magnets can be, for example, samarium-cobalt or neodymium-iron-boron (NIB) magnets.

The dimensions of the magnetic sub 130 can be selected such that the magnetic sub 130 can be conveyed to a desired location within the tubing string 120. By way of an example, the width of the magnetic sub 130 can be selected such that the magnetic sub 130 can fit within the inner diameter (I.D.) of the tubing string 120. Common inner diameters of tubing strings 120 range from 2 inches to 10+ inches. Accordingly, the width of the magnetic sub 130 can range from <2 inches to 5 inches.

Figure 4A:
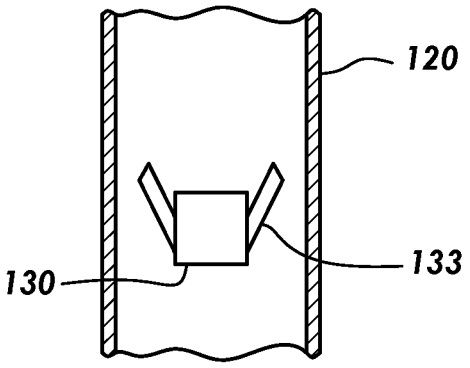
FIG. 4A is a partial cross-sectional view of a tubing string showing the magnetic sub with arms in a run-in position according to certain other embodiments.
Figure 4B:
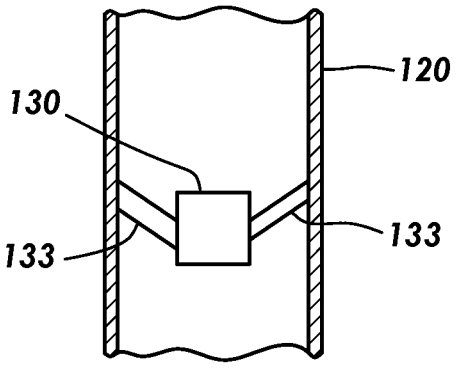
FIG. 4B is a partial cross-sectional view of the magnetic sub of FIG. 4A with the arms extended after being positioned at a desired location within the tubing string.

There may be instances in which the magnetic sub 130 must first pass through a tubing string 120 that has a smaller I.D. than the I.D. of the tubing string 120 at the desired location. According to these embodiments, and as shown in FIGS. 4A and 4B, the magnetic sub 130 can further include at least one set of foldable arms 133. There can be two or more sets of foldable arms 133. The foldable arms 133 can be made from a magnetic material, such as, steel. The foldable arms 133 can be located at a variety of positions around the outside of the magnetic sub 130.

As shown in FIG. 4A, the foldable arms 133 can be in a collapsed position during conveyance of the magnetic sub 130 via the run-in tool 140 (not shown in FIGS. 4A and 4B). This allows the magnetic sub 130 to fit within a tubing string 120 with a smaller I.D. According to any of the embodiments, the ends of the foldable arms 133 can be angled upwards towards the wellhead during run in. In this manner, any upward force from fluid within the tubing string 120 upon the foldable arms 133 does not prematurely move the arms into an expanded position. After the magnetic sub 130 has reached the desired location within the wellbore, the foldable arms 133 can be converted into an expanded position as shown in FIG. 4B. Although not required, the ends of the foldable arms 133 can contact the inside of the tubing string 120 in the expanded position. Conversion of the foldable arms into the expanded position can be accomplished via linear or rotary action of a setting tool for example.

Figure 5:
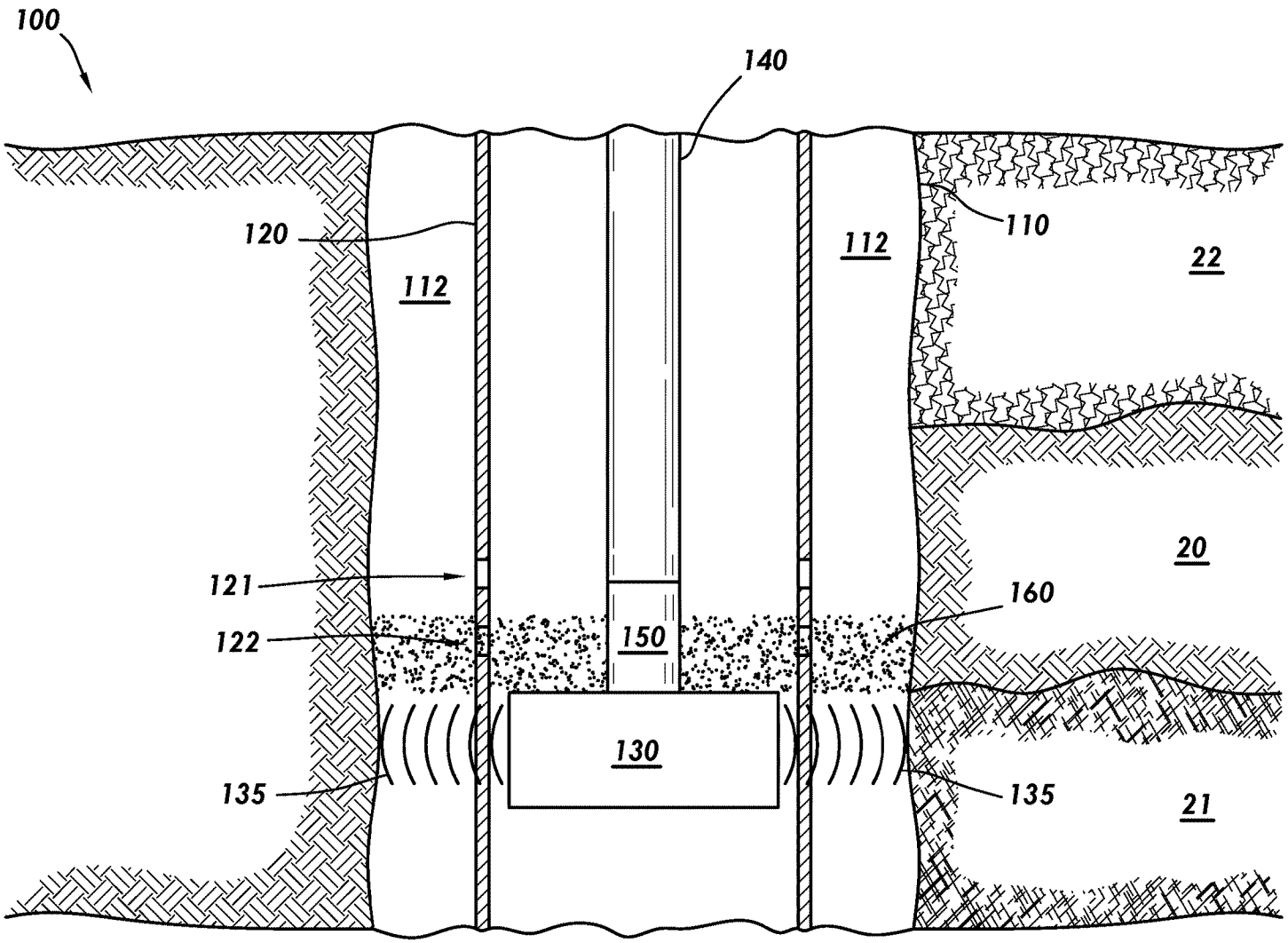
FIG. 5 is a cross-sectional view of the wellbore of FIG. 1 showing a ferromagnetic fluid as a temporary barrier according to certain embodiments.

Turning to FIG. 5, the wellbore system includes a ferromagnetic fluid 160. A ferromagnetic fluid is a colloid that includes ferromagnetic particles in a base fluid. The ferromagnetic particles are attracted to the poles of a magnet or electromagnetic field. Ferromagnetic particles can be suspended in the base fluid. The base fluid can be water-based or oil-based.

The ferromagnetic particles can have a particle size selected from nano-sized particles, micron-sized particles, and any combination thereof. Nanoparticles have a median particle size when measured at the largest dimension in the range of 1 to 100 nanometers (nm). Microparticles have a median particle size when measured at the largest dimension in the range of 1 to 1,000 micrometers (μm). The particle size distribution of the ferromagnetic particles can be selected such that some or all of the particles are affected by the strength of the electromagnetic field. By way of example, for low field magnetic fields, the particle size can be increased and for high field magnetic fields, the particle size can be increased. The ferromagnetic particles can also have a combination of different particle sizes, for example 0.091 to 0.525, such that some of the particles are affected by low field or high field magnetic fields.

Ferromagnetic fluids that contain microparticles are also known as magnetorheological fluids. Generally, nano-ferromagnetic particles can clump together when exposed to an electromagnetic field. Nano-ferromagnetic particles can be naturally suspended in the base fluid by Brownian motion and generally will not settle under normal conditions, while micro-ferromagnetic particles are generally too heavy to be suspended by Brownian motion. Thus, micro-ferromagnetic particles can settle within the base fluid over time depending on the difference in density of the ferromagnetic particles and the base fluid. According to any of the embodiments, the ferromagnetic particles in the ferromagnetic fluid 160 clump together in the presence of the electromagnetic field 135, settle out of the base fluid, or clump and settle. These embodiments can be useful to allow the ferromagnetic fluid 160 to form a temporary barrier. These embodiments can also be useful when the density of a zonal isolation fluid (discussed in more detail below) is greater than or equal to the density of the ferromagnetic fluid 160.

The concentration of the ferromagnetic particles in the ferromagnetic fluid 160 can be selected such that a temporary barrier having a desired height is formed. For example, if the temporary barrier that is formed needs to be relatively high, then an increased concentration can be used. According to any of the embodiments, the concentration of the ferromagnetic particles is selected such that an impermeable temporary barrier is formed. It is to be understood that an impermeable temporary barrier can allow some liquids or gases to flow through the temporary barrier; however, very little to none of the ingredients in the zonal isolation fluid that solidify should pass through the temporary barrier. For micro-ferromagnetic particles that predominately settle instead of clumping, a higher concentration of ferromagnetic particles may be needed compared to nano-ferromagnetic particles that can clump together. The concentration of the ferromagnetic particles in the base fluid can range from 2 mg/mL to 150 mg/mL (units). The concentration of the ferromagnetic particles can also be selected such that the ferromagnetic particles remain suspended in the base fluid until encountering the magnetic field. The concentration of the ferromagnetic particles can be selected based on the properties of the base fluid, for example, the viscosity of the base fluid or the concentration of a suspending agent added to the base fluid.

According to any of the embodiments, the ferromagnetic fluid 160 can include ingredients in addition to the ferromagnetic particles and the base fluid. FIG. 5 shows the ferromagnetic particles being relatively uniformly dispersed with the base fluid. A surfactant, dispersant, or suspending agent can be added to the base fluid to inhibit clumping of the ferromagnetic particles. For a surfactant, the magnetic attraction of the nanoparticles is weak enough that the surfactant's Van der Waals force is sufficient to prevent magnetic clumping or agglomeration. Including a surfactant, dispersant, or suspending agent in the ferromagnetic fluid 160 may be useful when the zonal isolation fluid has a density less than the density of the ferromagnetic fluid 160. Another example of an additional ingredient is a weighting agent. A weighting agent can be used to raise the density of the ferromagnetic fluid 160 to a density greater than the density of the zonal isolation fluid. The ferromagnetic fluid 160 can have a density of at least 4 pounds per gallon (ppg) (0.48 kilograms per liter (kg/l)). The ferromagnetic fluid 160 can have a density in the range of 4 to 20 ppg (about 0.48 to about 2.4 kg/l). Another example of an additional ingredient is a suspending agent for suspending the ferromagnetic particles during introduction into the wellbore. Another example of an additional ingredient is a corrosion inhibitor. A corrosion inhibitor can be helpful in reducing or preventing corrosion of the ferromagnetic particles, such as, for nanoparticles.

The methods can include introducing the ferromagnetic fluid 160 into the wellbore. The ferromagnetic fluid 160 can be introduced into the tubing string 120. The ferromagnetic fluid 160 can create a temporary barrier within the wellbore. The ferromagnetic fluid 160 can be pumped into the tubing string 120. When the ferromagnetic fluid 160 encounters the electromagnetic field 135 that is generated by the magnetic sub 130, the ferromagnetic fluid 160 is prevented from continuing downstream through the tubing string 120 due to the interaction of the ferromagnetic particles with the electromagnetic field 135. If zonal isolation is desired within the tubing string 120, then the tubing string 120 may not include the first set of perforations 121 or any other perforations. According to this embodiment, the ferromagnetic fluid 160 can be introduced into the tubing string 120, encounter the electromagnetic field 135, and remain inside the tubing string 120 at the location of the electromagnetic field 135.

As discussed above, one significant advantage to using the ferromagnetic fluid 160 instead of a mechanical barrier, such as an anchor/petal assembly, is the ability to create a temporary barrier within an annulus. As can be seen in FIG. 5, the ferromagnetic fluid 160 can flow into the annulus 112 from the tubing string 120 via the first set of perforations 121 and/or the second set of perforations 122. The ferromagnetic fluid 160 will be prevented from flowing further downstream within the annulus 112 due to the interaction of the ferromagnetic particles with the electromagnetic field 135 that is generated by the magnetic sub 130. Some of the base fluid of the ferromagnetic fluid 160 can flow past the magnetic sub 130, but the temporary barrier is formed adjacent to the electromagnetic field 135. The electromagnetic field 135 may need to be strengthened (e.g., by adding a core to an electromagnet) in order for the electromagnetic field 135 to extend completely through the annulus 112 to the wellbore wall 110 or inside of a casing string in a cased-hole wellbore. One can design the magnetic sub 130 based on the dimensions of the wellbore components and the concentration of the ferromagnetic particles among other parameters in order to create a temporary barrier that is capable of retaining a zonal isolation fluid at a desired location within the wellbore.

Figure 6:
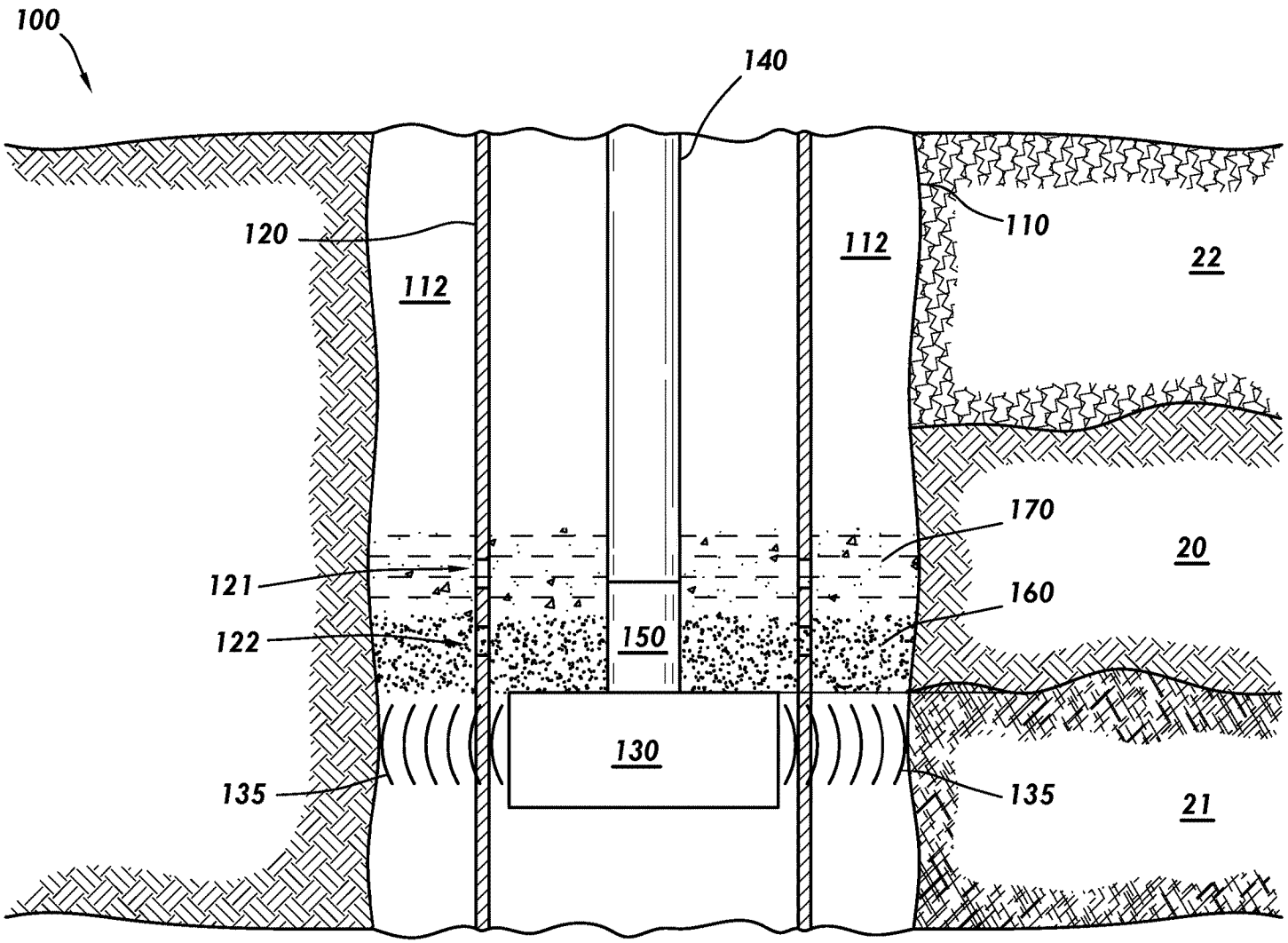
FIG. 6 is a cross-sectional view of the wellbore of FIG. 5 showing a plug above the ferromagnetic fluid according to certain embodiments.

Referring to FIG. 6, the wellbore system 100 also includes a zonal isolation fluid 170. The methods include introducing the zonal isolation fluid 170 into the wellbore. The zonal isolation fluid 170 can be introduced into the tubing string 120. The zonal isolation fluid 170 can be a powder that is introduced into the wellbore inside a container. The zonal isolation fluid 170 is introduced after the ferromagnetic fluid 160 is introduced into the wellbore. According to any of the embodiments, the zonal isolation fluid 170 is introduced after the ferromagnetic fluid 160 creates the temporary barrier, for example, after clumping and/or settling of the ferromagnetic particles. As can be seen in FIG. 6, the zonal isolation fluid 170 is located on top of and adjacent to the ferromagnetic fluid 160. If zonal isolation is desired within the annulus 112 and the tubing string 120 includes perforations, then the zonal isolation fluid 170 can flow into the annulus 112 via the first set of perforations 121. The temporary barrier that is formed by the ferromagnetic fluid 160 retains the zonal isolation fluid 170 within the tubing string 120 and/or the annulus 112 at the desired location to isolate the first zone 21 from the second zone 22 of the subterranean formation 20.

The zonal isolation fluid 170 can form a barrier within the tubing string 120 and/or the annulus 112. The barrier can be a permanent barrier or a semi-permanent barrier. The zonal isolation fluid 170 can be any fluid containing one or more ingredients that solidify. The ingredients that solidify can form the barrier after solidification. By way of example, the zonal isolation fluid 170 can be a metallic fluid. The metallic fluid can include a base fluid and metallic particles selected from metals, metal alloys, or combinations thereof. The metal or metal alloy of the metallic particles can be selected from bismuth, silver, zinc, and combinations thereof.

By way of another example, the zonal isolation fluid 170 can be a cement composition. The cement composition can include water as the base fluid. The water can be selected from the group consisting of freshwater, brackish water, and saltwater, in any combination thereof in any proportion. The cement composition can further include a hydrocarbon liquid. The cement composition can also include a water-soluble salt. The salt, according to any of the embodiments, can be selected from sodium chloride, calcium chloride, calcium bromide, potassium chloride, potassium bromide, magnesium chloride, and any combination thereof in any proportion. The salt can be in a concentration in the range of about 0.1% to about 40% by weight of the water.

The cement composition includes cement. The cement can be a hydraulic cement. A variety of hydraulic cements can be utilized, including, but not limited to, those comprising calcium, aluminum, silicon, oxygen, iron, and/or sulfur, which set and harden by a reaction with water. Suitable hydraulic cements include, but are not limited to, Portland cements, gypsum cements, high alumina content cements, slag cements, high magnesia content cements, pozzolan, fly ash, lime, slaked lime, sorels cements, and combinations thereof. The cement composition can further include additional additives. Examples of additional additives include, but are not limited to, a high-density additive, a filler, a strength-retrogression additive, a set accelerator, a set retarder, a friction reducer, a mechanical property enhancing additive, a lost-circulation material, a filtration-control additive, a defoaming agent, a thixotropic additive, a nanoparticle, and combinations thereof. The cement composition can have a density of at least 4 pounds per gallon (ppg) (0.48 kilograms per liter (kg/l)). The cement composition can have a density in the range of 4 to 20 ppg (about 0.48 to about 2.4 kg/l).

By way of yet another example, the zonal isolation fluid 170 can be a resin composition. The resin composition can include a base fluid, insoluble particles, a curable resin, and optionally a curing agent. Alternatively, the resin composition can include the base fluid, the insoluble particles, and the curable resin. A subsequent fluid containing a curing agent can be introduced into the wellbore after introduction of the resin composition to cure the curable resin.

The resin composition can include ingredients known to those of ordinary skill in the art. The insoluble particles can be, for example, proppant, gravel, or combinations thereof. The curable resin can be any compound that is capable of curing (i.e., the process of gaining compressive strength and solidifying). Preferably, the curable resin is water dispersible. As used herein, the term "water dispersible" means that at least 1 part of the compound disperses in at least 5 parts of the water. The curable resin can cure via a chemical reaction with a curing agent or by heat. The curable resin can have an affinity for the insoluble particles. In this manner, the curable resin can be attracted to the particles. The curable resin can also coat the particles prior to curing. The curable resin can also chemically bond with the surfaces of the particles. An example of a curable resin is an epoxy silane resin. The curable resin can be an epoxy, diepoxy, or polyepoxy silane resin. The curing agent causes the curable resin to cure. Unlike other curable resins that can cure due to heat or other physical parameters, the curing agent is responsible for causing the curable resin to cure. The curing agent can also cross-link the polymer molecules of the curable resin. The curing agent can be, for example, a dimer acid, a dimer diamine, or a trimer acid.

The methods can include causing at least a portion of the zonal isolation fluid 170 to solidify. Causing at least a portion of the zonal isolation fluid 170 to solidify forms a barrier within the tubing string 120 and/or the annulus 112 to provide zonal isolation from the first zone 21 to the second zone 22 of the subterranean formation 20.

For a metallic fluid as the zonal isolation fluid 170, the metallic particles can melt at a temperature greater than or equal to the melting point of the metallic particles. The step of solidifying can include increasing the temperature at the location of the zonal isolation fluid 170 to a temperature greater than or equal to the melting point of the metallic particles. This can be achieved, for example, by activating the heater 150; initiating a thermite reaction, which is exothermic and produces heat; or introducing a heated fluid into the wellbore. The metallic particles may also melt without any action when the subterranean formation 20 at the location of the zonal isolation fluid 170 has a temperature greater than or equal to the melting point of the metallic particles. Upon cooling, the melted metallic particles will solidify and fuse together to form the zonal isolation barrier. In order for the metallic particles to solidify, the temperature needs to decrease to a temperature below the melting point of the metallic particles. This temperature decrease can be achieved by deactivating the heater 150, allowing the thermite reaction to completely proceed, cessation of pumping a heated fluid into the wellbore, or pumping a cooling fluid into the wellbore.

For a cement composition as the zonal isolation fluid 170, solidification for a cement composition can include allowing the cement composition to set. A set accelerator can be added to the cement composition when it is desirable to shorten the setting time. The heater 150 can also be used to shorten the setting time of the cement composition.

For a resin composition as the zonal isolation fluid 170, the curable resin can cure and solidify with heat. This can be achieved, for example, by activating the heater 150; initiating a thermite reaction, which is exothermic and produces heat; or introducing a heated fluid into the wellbore. The curable resin may also cure without any action when the subterranean formation 20 at the location of the zonal isolation fluid 170 has a temperature greater than or equal to the curing temperature of the curable resin. The curable resin can be introduced into the wellbore along with the insoluble particles and the base fluid. The curable resin can also be introduced after the zonal isolation fluid 170 containing the insoluble particles and the base fluid have been introduced. If the curable resin cures with heat, then a curing agent can be omitted. Conversely, for curable resins that cure with a curing agent, the methods can further include introducing the curing agent into the wellbore. The curing agent can be introduced after the curable resin has coated and consolidated the insoluble particles.

Figure 7:
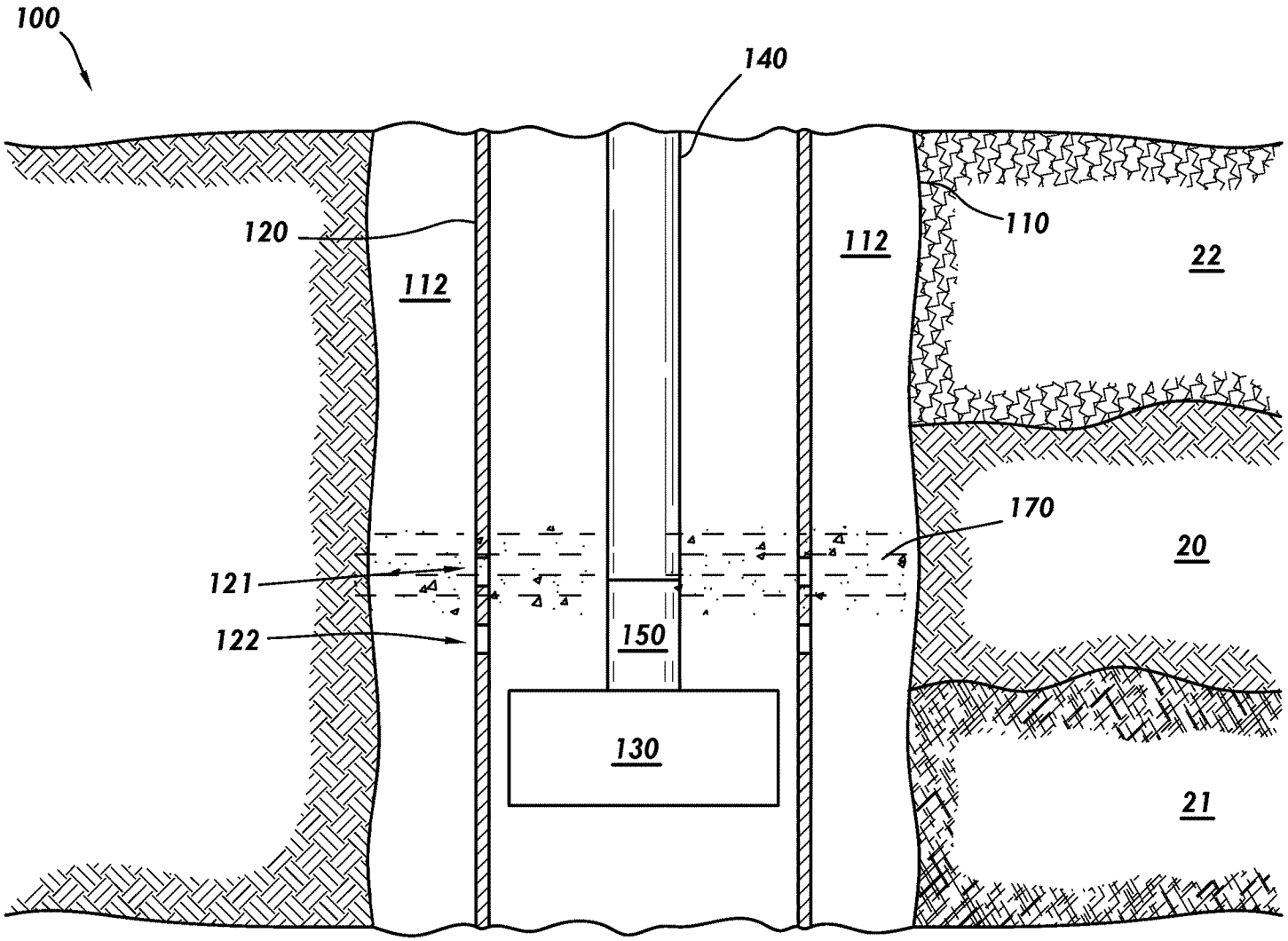
FIG. 7 is a cross-sectional view of the wellbore of FIG. 6 showing removal of the ferromagnetic fluid according to certain embodiments.

Referring to FIG. 7, the methods can further include flowing the ferromagnetic fluid 160 (not shown in FIG. 7) from the wellbore. As discussed above, the ferromagnetic fluid can form the temporary barrier for the zonal isolation fluid 170 because of the electromagnetic field generated by the magnetic sub 130. The methods can further include causing or allowing the magnetic sub 130 to demagnetize. This can be accomplished by turning off the power source providing electrical current to electromagnetic coils 132 or allowing a permanent magnet made of a soft material to naturally demagnetize. As can be seen in FIG. 7, when the magnetic sub 130 demagnetizes and no electromagnetic field is generated, the ferromagnetic fluid is no longer retained by the electromagnetic field. This allows the ferromagnetic fluid to flow downstream and out of the wellbore. After the ferromagnetic fluid has been flowed from the wellbore and the temporary barrier no longer exists, the zonal isolation barrier formed from solidification of the zonal isolation fluid 170 remains within the wellbore. The zonal isolation barrier can be left intact or removed, for example, by milling or chemically breaking down the barrier, such as with an acidizing fluid.

An embodiment of the present disclosure is a wellbore system comprising: a wellbore; a ferromagnetic fluid, wherein the ferromagnetic fluid creates a temporary barrier within the wellbore; a magnetic sub, wherein the magnetic sub is configured to generate an electromagnetic field; and a zonal isolation fluid, wherein the zonal isolation fluid is retained at a desired location within the wellbore via the temporary barrier. Optionally, the system further comprises a heater, wherein the heater is configured to be conveyed into a tubing string located within the wellbore. Optionally, the system further comprises wherein the magnetic sub is an electromagnetic coil. Optionally, the system further comprises a power source configured to produce an electrical current to produce the electromagnetic field. Optionally, the system further comprises wherein the electromagnetic sub further comprises a ferromagnetic core, and wherein the electromagnetic coil wraps around the ferromagnetic core. Optionally, the system further comprises wherein the magnetic sub is a permanent magnet. Optionally, the system further comprises wherein the ferromagnetic fluid comprises ferromagnetic particles and a base fluid. Optionally, the system further comprises wherein the zonal isolation fluid is selected from a metallic fluid, a cement composition, or a resin composition.

Another embodiment of the present disclosure is a method of isolating a first zone from a second zone of a subterranean formation comprising: introducing a magnetic sub into a wellbore, wherein the wellbore penetrates the subterranean formation; causing or allowing the magnetic sub to generate a magnetic field; introducing a ferromagnetic fluid into the wellbore to form a temporary barrier within the wellbore, wherein the temporary barrier is located adjacent to the magnetic field; introducing a zonal isolation fluid into the wellbore, wherein the zonal isolation fluid is located adjacent to the temporary barrier; and causing or allowing at least a portion of the zonal isolation fluid to solidify. Optionally, the method further comprises wherein the magnetic sub further comprises at least one set of foldable arms, wherein the at least one set of foldable arms is in a collapsed position during introduction of the magnetic sub into the wellbore, and wherein the at least one set of foldable arms convert to an expanded position after introduction of the magnetic sub into the wellbore. Optionally, the method further comprises wherein the ferromagnetic fluid comprises ferromagnetic particles and a base fluid. Optionally, the method further comprises wherein the ferromagnetic particles have a particle size selected from nano-sized particles, micron-sized particles, or combinations thereof. Optionally, the method further comprises wherein the temporary barrier is formed by the ferromagnetic particles clumping together, settling out of the base fluid, or clumping together and settling out of the base fluid when in the presence of the electromagnetic field. Optionally, the method further comprises wherein the zonal isolation fluid is introduced after the ferromagnetic fluid creates the temporary barrier. Optionally, the method further comprises a tubing string located within the wellbore, wherein the ferromagnetic fluid and the zonal isolation are introduced into the tubing string, and wherein the temporary barrier is formed within the tubing string. Optionally, the method further comprises a tubing string located within the wellbore, wherein the tubing string comprises at least two sets of perforations; and an annulus located outside of the tubing string, wherein the ferromagnetic fluid and the zonal isolation are introduced into the annulus via the at least two sets of perforations, and wherein the temporary barrier is formed within the annulus. Optionally, the method further comprises wherein the zonal isolation fluid is selected from a metallic fluid, a cement composition, or a resin composition, and wherein the metallic fluid comprises a base fluid and metallic particles selected from metals, metal alloys, or combinations thereof. Optionally, the method further comprises wherein causing at least a portion of the zonal isolation fluid to solidify comprises increasing the temperature at the location of the zonal isolation fluid to a temperature greater than or equal to the melting point of the metallic particles. Optionally, the method further comprises wherein the temperature is increased via a heater or an exothermic reaction of reactants. Optionally, the method further comprises wherein the exothermic reaction is a thermite reaction.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more sets of perforations, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A wellbore system comprising:

a wellbore;

a ferromagnetic fluid;

one magnetic sub, wherein the magnetic sub is configured to generate an electromagnetic field, wherein the ferromagnetic fluid creates a barrier at a location above the magnetic sub when the electromagnetic field is generated and does not create a barrier when the electromagnetic field is not generated; and a zonal isolation fluid, wherein the zonal isolation fluid is retained at a desired location within the wellbore via the barrier.

2. The wellbore system according to claim 1, further comprising a heater, wherein the heater is configured to be conveyed into a tubing string located within the wellbore.

3. The wellbore system according to claim 1, wherein the magnetic sub is an electromagnetic coil.

4. The wellbore system according to claim 3, further comprising a power source configured to produce an electrical current to produce the electromagnetic field.

5. The wellbore system according to claim 3, wherein the electromagnetic sub further comprises a ferromagnetic core, and wherein the electromagnetic coil is wrapped around the ferromagnetic core.

6. The wellbore system according to claim 1, wherein the magnetic sub is a permanent magnet.

7. The wellbore system according to claim 1, wherein the ferromagnetic fluid comprises ferromagnetic particles and a base fluid.

8. The wellbore system according to claim 1, wherein the zonal isolation fluid is a metallic fluid, a cement composition, or a resin composition.

9. A method of isolating a first zone from a second zone of a subterranean formation comprising:

introducing one magnetic sub into a wellbore, wherein the wellbore penetrates the subterranean formation;

causing or allowing the magnetic sub to generate an electromagnetic field;

introducing a ferromagnetic fluid into the wellbore to form a barrier within the wellbore when the electromagnetic field is generated, wherein the barrier is located adjacent to the electromagnetic field;

introducing a zonal isolation fluid into the wellbore, wherein the zonal isolation fluid is located adjacent to the barrier; and causing or allowing at least a portion of the zonal isolation fluid to solidify.

10. The method according to claim 9, wherein the magnetic sub further comprises at least one set of foldable arms, wherein the at least one set of foldable arms is in a collapsed position during introduction of the magnetic sub into the wellbore, and wherein the at least one set of foldable arms convert to an expanded position after introduction of the magnetic sub into the wellbore.

11. The method according to claim 9, wherein the ferromagnetic fluid comprises ferromagnetic particles and a base fluid.

12. The method according to claim 11, wherein the ferromagnetic particles have a particle size selected from nano-sized particles, micron-sized particles, or combinations thereof.

13. The method according to claim 11, wherein the barrier is formed by the ferromagnetic particles clumping together, settling out of the base fluid, or clumping together and settling out of the base fluid when in the presence of the electromagnetic field.

14. The method according to claim 13, wherein the zonal isolation fluid is introduced after the ferromagnetic fluid creates the barrier.

15. The method according to claim 9, further comprising a tubing string located within the wellbore, wherein the ferromagnetic fluid and the zonal isolation are introduced into the tubing string, and wherein the barrier is formed within the tubing string.

16. The method according to claim 9, further comprising:

a tubing string located within the wellbore, wherein the tubing string comprises at least two sets of perforations; and an annulus located outside of the tubing string, wherein the ferromagnetic fluid and the zonal isolation are introduced into the annulus via the at least two sets of perforations, and wherein the barrier is formed within the annulus.

17. The method according to claim 9, wherein the zonal isolation fluid is a metallic fluid, a cement composition, or a resin composition, and wherein the metallic fluid comprises a base fluid and metallic particles selected from metals, metal alloys, or combinations of metals and metal alloys.

18. The method according to claim 17, wherein causing at least a portion of the zonal isolation fluid to solidify comprises increasing a temperature at a location of the zonal isolation fluid to a temperature greater than or equal to a melting point of the metallic particles.

19. The method according to claim 18, wherein the temperature is increased via a heater introduced into the wellbore or an exothermic reaction of reactants.

20. The method according to claim 19, wherein the exothermic reaction is a thermite reaction.

* * * * *